US006513684B1

(12) United States Patent
Bougamont et al.

(10) Patent No.: US 6,513,684 B1
(45) Date of Patent: Feb. 4, 2003

(54) END CAP FOR DISPENSING AND SPRAYING LIQUID PHARMACEUTICAL PRODUCTS

(75) Inventors: Jean-Louis Bougamont, Eu (FR); Pascal Hennemann, Eu (JP); David Leuliet, Mers-les-Bains (FR)

(73) Assignee: Rexam Sofab, le Treport (FR)

( * ) Notice: Subject to any disclaimer, the term of this patent is extended or adjusted under 35 U.S.C. 154(b) by 0 days.

(21) Appl. No.: 09/926,440

(22) PCT Filed: May 5, 2000

(86) PCT No.: PCT/FR00/01224

§ 371 (c)(1),
(2), (4) Date: Nov. 5, 2001

(87) PCT Pub. No.: WO00/68110

PCT Pub. Date: Nov. 16, 2000

(30) Foreign Application Priority Data

May 5, 1999 (FR) ..... 9905694

(51) Int. Cl.[7] ..... B65D 47/00
(52) U.S. Cl. ..... 222/548; 222/321.9; 222/537
(58) Field of Search ..... 222/321.9, 402.1, 222/501, 537, 548, 634

(56) References Cited

U.S. PATENT DOCUMENTS 5,791,518 A * 8/1998 Amann et al. ..... 222/321.9
6,109,547 A * 8/2000 Ritsche ..... 222/22

* cited by examiner

*Primary Examiner*—Henry C. Yuen
*Assistant Examiner*—Melvin A. Cartagena
(74) *Attorney, Agent, or Firm*—Bacon & Thomas, PLLC

(57) ABSTRACT

An endpiece for dispensing liquid pharmaceuticals contained in a receptacle, the endpiece being of the type comprising a tubular element (1) provided at a free first end (1*a*) with a spray nozzle (3) and at its second end (1*b*) with a rotary coupling (11) providing a connection with the internal delivery duct (20) of a pushbutton (2) for fitting onto the top of a tapping member mounted on said receptacle, said rotary coupling (11) being constituted by a core having a cylindrical cavity (21) fitted to said pushbutton (2) in communication with the internal delivery duct (20) and in which the second end (1*b*) of the tubular element (1) is engaged in touching and rotary manner, which second end is provided with means for opening said duct (20), the endpiece being characterized in that said cylindrical cavity (21) contains an axial rod (22) secured to the pushbutton (2) for being engaged inside the second end (1*b*) of said tubular element (1) while leaving an intermediate space (21*c*) through which the pharmaceutical is transferred.

12 Claims, 2 Drawing Sheets

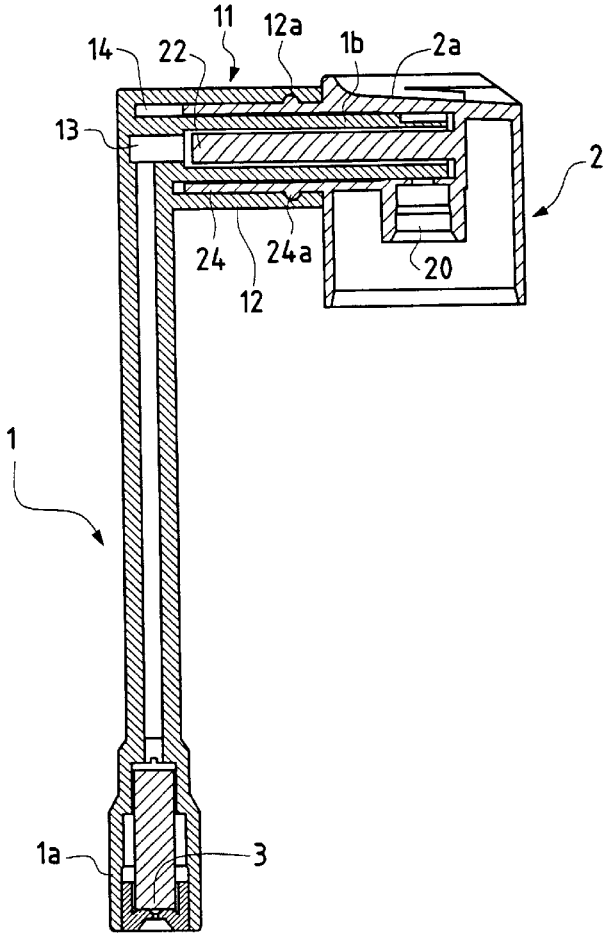
FIG.1A
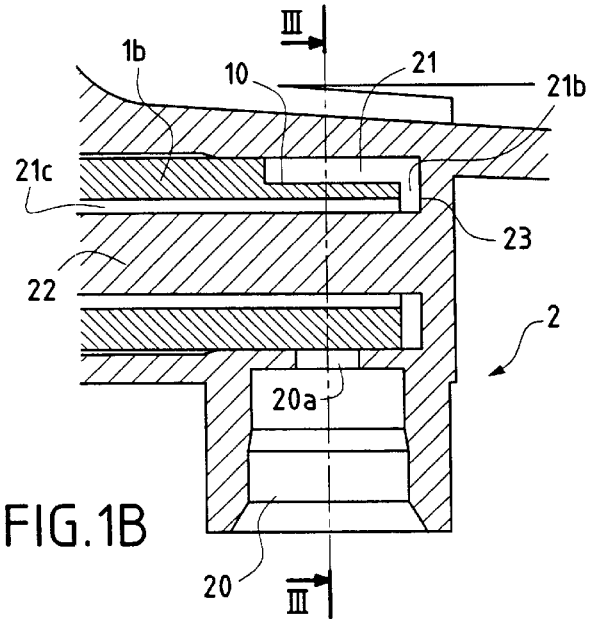
FIG.1B
FIG.3
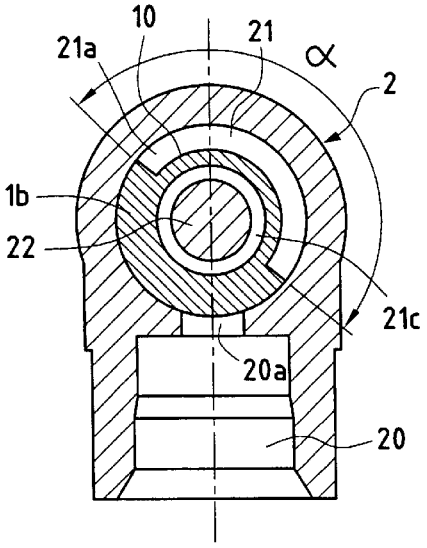

END CAP FOR DISPENSING AND SPRAYING LIQUID PHARMACEUTICAL PRODUCTS

The present invention relates to an endpiece for dispensing and spraying liquid pharmaceuticals.

More particularly, the invention applies to an endpiece of the type comprising a tubular element provided at a free first end with a spray nozzle and at its second end with a rotary coupling connecting it with the internal delivery duct of a pushbutton for fitting on the top of the outlet tube of a tapping member mounted on said receptacle.

Unfortunately, such endpieces do not provide a closed position, thereby giving rise to a risk of accidental spraying and thus of liquid flowing out in untimely manner.

An object of the present invention is to solve that technical problem in effective manner.

According to the invention, this object is achieved by means of an endpiece of the above type in which the rotary coupling is constituted by a core having a cylindrical cavity fitted to said pushbutton in communication with the internal delivery duct, and in which the second end of the tubular member is engaged in touching and rotary manner, which second end is provided with means for opening said duct.

In a particular embodiment, said cylindrical cavity contains an axial rod secured to the pushbutton for being engaged inside the second end of said tubular element while leaving an intermediate space through which the pharmaceutical is transferred.

According to an advantageous characteristic, said internal delivery duct opens out laterally into said cavity via an ejection orifice.

Preferably, the tubular element and the pushbutton comprise snap-fastening members suitable for co-operating releasbly to position the second end in an angular position in which it closes the delivery duct.

In another embodiment, said cavity is defined by the wall of a cylindrical spout projecting from the side wall of the pushbutton.

In a variant, the wall of said spout carries a peripheral ring for co-operating by snap-fastening in a groove of complementary profile formed in the wall of the tubular element to ensure that the second end of the tubular element is properly positioned and held in said cavity.

In another variant, the second end of the tubular element is provided with an outer coaxial sleeve defining an intermediate space in which the cylindrical spout of the pushbutton is received.

In yet another embodiment, said means for opening the delivery duct is constituted by a discontinuity in the wall of the second endpiece of the tubular element leaving a lateral passage for the liquid pharmaceutical.

In a first variant, said discontinuity is in the form of a gap formed over an angular fraction of the wall of the tubular element.

In another variant, said discontinuity is in the form of a reduction in wall thickness formed over an angular fraction of the wall of the tubular element.

According to another characteristic, said tubular element possesses an intermediate zone that is bent or articulated.

Preferably, a position in which the internal delivery duct is closed corresponds to the first end of the tubular element being pointed downwards.

According to another characteristic, the length of the tubular element engaged in said cylindrical cavity is determined in such a manner as to leave an empty space between the end wall of said cavity and the longitudinal edge of said second end.

The endpiece of the invention can be pointed in a wide variety of ways, thus making it easier to take medicine in various open positions that are suitable for spraying.

In contrast, the endpiece preferably possesses a single lockable closed position corresponding to the tubular element pointing downwards, thus making the packaging assembly (receptacle plus endpiece) as compact as possible for storage.

The invention will be better understood on reading the following description given with reference to the accompanying drawings, in which:

FIG. 1A is a section view of the endpiece of the invention in its closed position;

FIG. 1B is a detail section view through the FIG. 1A endpiece;

FIGS. 3 and 4 are section views on AA showing two variant embodiments of the rotary coupling of the endpiece when in the closed position.

Figure 2A:
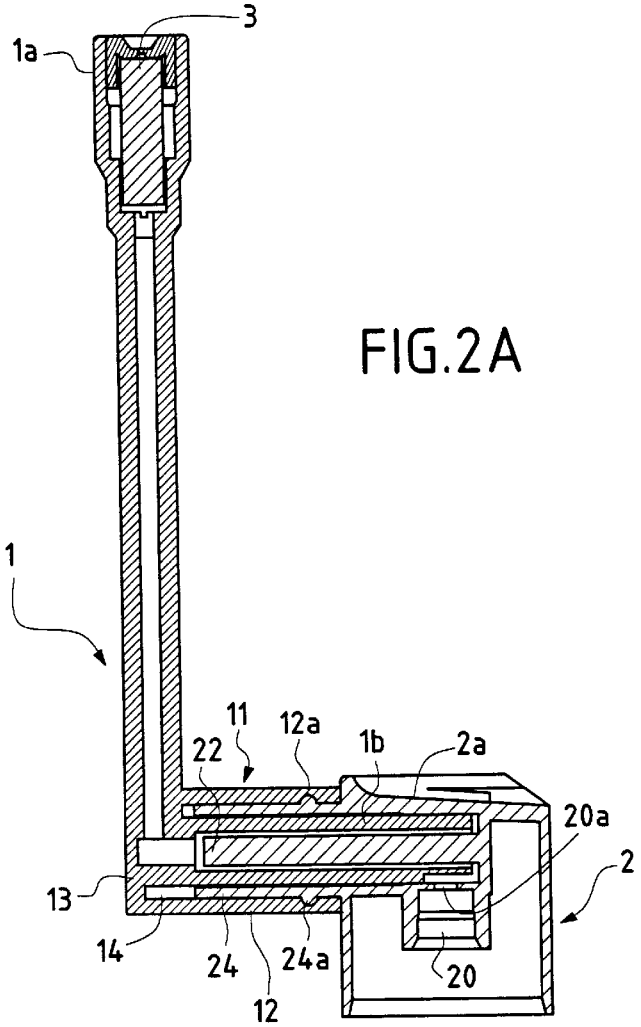
FIG. 2A is a section view of the FIG. 1A endpiece in the open position.

The endpiece shown in FIGS. 1A and 2A is intended more particularly for dispensing and spraying liquid and semi-liquid pharmaceuticals from a receptacle fitted with a tapping member and/or metering-out member such as a pump or a valve (not shown). The packaging as a whole can contain a collutory preparation.

In conventional manner, the tapping member possesses an outlet tube whose end is designed to be covered by a pushbutton 2 possessing an internal duct 20 and presenting a top face 2*a* for receiving finger pressure.

The endpiece comprises a tubular element 1 that is of longer or shorter length, provided at a free first end 1*a* with a spray nozzle 3 and at its second end 1*b* with a rotary coupling 11.

The coupling 11 provides hydraulic and mechanical connection between the tubular element 1 and the internal delivery duct 20 which extends the outlet tube of the tapping member. The tubular element 1 can be rotated about the coupling axis 11 in order to ensure that the spray nozzle 3 points in an appropriate direction.

In the embodiment shown, the first end 1*a* of the tubular element 1 is connected to the second end 1*b* via an intermediate zone 13 that is bent or articulated.

Figure 2B:
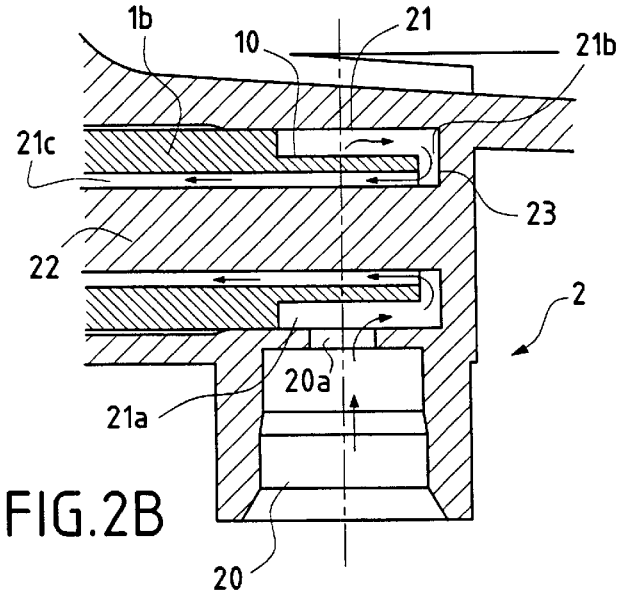
FIG. 2B is a detail section view of the FIG. 1A endpiece in its FIG. 2A position.

The. rotary coupling 11 shown in detail in FIGS. 1B and 2B is constituted by a valve-forming bore having a cylindrical cavity 21, fitted to the pushbutton 2, and communicating with said internal delivery duct 20 via an ejection orifice 20*a* which in this case opens out laterally into the cavity 21.

The second end 1*b* of the tubular element 1 is engaged in touching and rotary manner inside the cavity 21, thereby closing the orifice 20*a* in leaktight manner as shown in FIG. 1B.

Nevertheless, the second end 1*b* of the tubular element 1 is provided in its side wall with means for opening the orifice 20*a*.

The opening means is constituted by a discontinuity 10 in the wall of the element 1 leaving a lateral passage 21*a* inside the cavity 21 through which the liquid pharmaceutical can pass.

In this case, the cavity 21 is defined by the wall of a cylindrical spout 24 projecting from a front side wall of the pushbutton 2.

The cavity 21 contains an axial rod 22 secured to its end wall 23 for engaging inside the second end 1*b* of the tubular element 1 while leaving an intermediate space 21*c* for transferring the liquid pharmaceutical towards the nozzle 3. The rod 22 serves in particular to reduce the amount of dead volume inside the endpiece and the number of priming strokes necessary in order to obtain a first jet of spray.

The axis of the rod 22 coincides in this case with the axis of the cavity 21 and with the axis of rotation of the tubular element 1.

The length of the tubular element 1 that is engaged in the cavity 21 is determined in such a manner as to leave an empty space 21*b* between the end wall 23 of said cavity and the upstream longitudinal edge of the second end 1*b*.

In the position of FIG. 2B relating to the embodiment of FIG. 3, the empty space 21*b* in the open position allows the pharmaceutical coming from the orifice 20*a* to penetrate via the lateral passage 21*a* into the tubular element 1, as shown by the arrows.

The second end 1*b* of the tubular element is provided in the embodiments of FIGS. 1A and 2A with an outer coaxial sleeve 12 co-operating with the wall of the second end 1*b* to define an intermediate space 14 in which the spout 24 of the pushbutton 2 is received with a small amount of radial tightness.

The wall of the spout 24 carries a peripheral ring 24*a* for co-operating, possibly by releasable snap-fastening, with a groove 12*a* of complementary profile formed in the wall of the tubular element, and in this case of the sleeve 12, so as to ensure that the second end 1*b* is retained in the cavity 21 and is properly positioned therein.

The relative locations of the ring 24*a* and of the groove 12*s* are determined as a function of the respective lengths of the second end 1*b* and of the cavity 21, in particular so as to leave the space 21*b* at the end of the cavity empty.

The orifice 20*a* of the delivery duct 20 is closed in leaktight manner in this case by the first end 1*a* of the tubular element 1 being pointed downwards (FIGS. 1A and 1B).

Nevertheless, it is possible to provide a plurality of angular positions for closure.

The tubular element 1 and the pushbutton 2 have snap-fastening means (not shown) suitable for co-operating so as to be easily releasable, in order to position and lock the second end 1*b* so that it is prevented from rotating away from an angular closure position.

This co-operation is preferably accompanied by a click informing the user that the proper closure position has been reached.

In the embodiment shown in FIGS. 1B, 2B, and 3, the means for opening the delivery duct 20 is constituted by a discontinuity 10 in the form of the wall of the tubular element 1 being of reduced thickness. This reduced thickness occupies an angular fraction $\alpha$.

Figure 4:
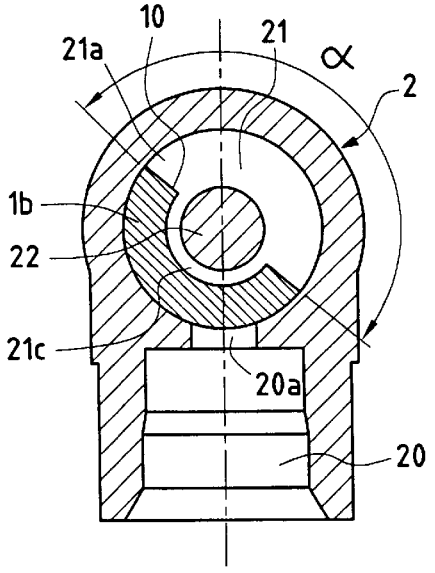

In the embodiment shown in section in FIG. 4, the discontinuity 10 is in the form of a gap made either directly by molding or else by cutting material away from an angular fraction a of the wall of the tubular element

What is claimed is:

1. An endpiece for dispensing liquid pharmaceuticals contained in a receptacle, comprising an opening device arranged to open a tubular element (1) provided at a free first end (1*a*) with a spray nozzle (3) and at a second end (1*b*) with a rotary coupling (11) providing a connection with an internal delivery duct (20) of a pushbutton (2) arranged to fit onto a top of a tapping member mounted on said receptacle, said rotary coupling (11) comprising a core having a cylindrical cavity (21) fitted to said pushbutton (2) and in communication with the internal delivery duct (20) and in which the second end (1*b*) of the tubular element (1) is engaged in a touching and rotary manner, said second end being provided with an opening device arranged to open said duct (20), said cylindrical cavity (21) containing an axial rod (22) secured to the pushbutton (2) in a manner so that said rod is engaged inside the second end (1*b*) of said tubular element (1) while leaving an intermediate space (21*c*) through which a pharmaceutical may be transferred while reducing the dead volume.

2. The endpiece according to claim 1, wherein said internal delivery duct (20) opens out laterally into said cavity (21) via an ejection orifice (20*a*).

3. The endpiece according to claim 1, wherein the tubular element (1) and the pushbutton (2) comprise snap-fastening members arranged to releasably cooperate to position the second end (1*b*) in an angular position in which it closes the delivery duct (20).

4. The endpiece according to claim 1, wherein said cavity (21) is defined by the wall of a cylindrical spout (24) projecting from the side wall of the pushbutton (2).

5. The endpiece according to claim 4, wherein the wall of said spout (24) carries a peripheral ring (24*a*) for co-operating by snap-fastening in a groove (12*a*) of a complementary profile formed in the wall of the tubular element (1) to ensure that the second end (1*b*) of the tubular element is properly positioned and held in said cavity (21).

6. The endpiece according to claim 4, wherein the second end (1*b*) of the tubular element (1) is provided with an outer coaxial sleeve (12) defining an intermediate space (14) in which the cylindrical spout (24) of the pushbutton (2) is received.

7. The endpiece according to claim 1, wherein said opening device includes a discontinuity (10) in the wall of the second endpiece (1*b*) of the tubular element (1) leaving a lateral passage (21*a*) for liquid pharmaceutical.

8. The endpiece according to claim 7, wherein said discontinuity (10) is in the form of a gap formed over an angular fraction ($\alpha$) of the wall of the tubular element (1).

9. The endpiece according to claim 7, wherein said discontinuity (10) is in the form of a reduction in wall thickness formed over an angular fraction ($\alpha$) of the wall of the tubular element (1).

10. The endpiece according to claim 1, wherein said tubular element (1) includes an intermediate zone (13) that is bent or articulated.

11. The endpiece according to claim 10, wherein a position in which the internal delivery duct (20) is closed corresponds to the first end (1*a*) of the tubular element (1) being pointed downwards.

12. The endpiece according to claim 1, wherein the length of the tubular element (1) engaged in said cylindrical cavity (21) is determined in such a manner so as to leave an empty space (21*b*) between the end wall (23) of said cavity (21) and the longitudinal edge of said second end (1*b*).

* * * * *